US005251390A

United States Patent [19]

Wong

[11] Patent Number: 5,251,390

[45] Date of Patent: Oct. 12, 1993

[54] SNOWPLOW

[76] Inventor: Michael Wong, 2369 Kingston Road East, P.O. Box 28013, Scarborough, Ontario, Canada, M1N 1T0

[21] Appl. No.: 991,357

[22] Filed: Dec. 15, 1992

[51] Int. Cl.[5] ..... E01H 5/06

[52] U.S. Cl. ..... 37/231; 37/273; 37/276; 37/269; 37/270

[58] Field of Search ..... 37/269, 268, 273, 276, 37/231, 270, 271

[56] References Cited

U.S. PATENT DOCUMENTS 3,448,534 6/1969 Pipes et al. ..... 37/273
3,898,753 8/1975 Kinnunen ..... 37/273
4,159,584 7/1979 Niemela ..... 37/273 X
4,658,519 4/1987 Quenzi ..... 37/273 X
4,796,367 1/1989 Kulat ..... 37/273
4,802,293 2/1989 Smith ..... 37/271 X
4,907,358 3/1990 Moore ..... 37/273 X

*Primary Examiner*—Randolph A. Reese
*Assistant Examiner*—J. Russell McBee

[57] ABSTRACT

A snowplow consisting of two hinged plates is removably mountable on the front or back frame or bumper of an automobile. The mounting and the plates are adapted to slope the plates at 270°-240° of each other.

14 Claims, 2 Drawing Sheets

SNOWPLOW

This invention to a snowplow for automobiles.

BACKGROUND OF THE INVENTION

A light, convenient plow is needed for automobile owners who wish to plow their laneway without having to own or have access to a snowplow.

There is therefore provided, a plow constructed of a pair of hinged plates which form such a plow when attached to to the rear, or to the front, of an auto.

Plows have previously been provided which will mount on an automobile but, as far as I know, have not been made in collapsible form so that they may be easily lifted on the automobile and easily lifted off the automobile, and folded into parallel relationship for storing in the automobile or elsewhere when not in use.

In accord with a broad aspect of the invention a pair of hinged plates are designed to have an inner and an outer face relative to the auto and a lower edge approximately perpendicular to the hinge axis. The inward faces of each of the plates are provided with means for mounting that plate on one side of an auto chassis outward of the auto, with said plates and the hinge axis approximately vertical. The mounting will be designed to allow the plates to move up and down relative to the automobile in accord with ground contours. The pivotally connected plates are designed in use to assume an angle of 270° and 240° between the outer faces, and when not in use are adapted to collapse to an angle where the inner faces are adjacent and nearly parallel.

In accord with a preferred form of the invention a pair of shafts in parallel and approximately vertical orientation are provided for mounting on the rear or the front of a vehicle outwardly of any bumper. A pair of hinged plates are designed to have an inner and an outer face relative to the automobile. The inward faces of the plates are provided with brackets adapted to slide on and off said standards. The plates should be dimensioned and the brackets located so that the hinged plates will when mounted on the standards assume an angle (measured between the outer faces) of between 270° and 240°. An angle of less than 240° between these outer faces will risk buckling of the plates under plowing conditions. I prefer to use an angle of about 250°.

Preferably the extent of the plates below the bracket mount is sufficient that the plates are supported by their ground support means above the lower limit of their possible sliding travel on the shafts. The standards are further designed so that there is a substantial vertical extent through which the plates may slide on the standards to conform to various ground heights. This will allow the plates in use to slide upwardly and downwardly on the standard to conform to small changes in ground contour.

The mounts for the parallel shafts on the automobile may be widely varied within the scope of the invention. However, it is noted that in the preferred form the shafts 20 are mounted on the outward end of arms attached to the chassis and extending under the bumper. Since the bumper and chassis height relative to the ground will vary widely from automobile to automobile, the mount is preferably designed to give a relatively wide choice of heights of the arm relative to the chassis.

In a preferred aspect of the invention each plate is provided with both left and right hand mounting means so that only a simple die is required since each plate may act as a right or a left plate.

In drawings which illustrate a preferred embodiment of the invention:

DETAILED DESCRIPTION OF THE DRAWINGS

Figure 1:
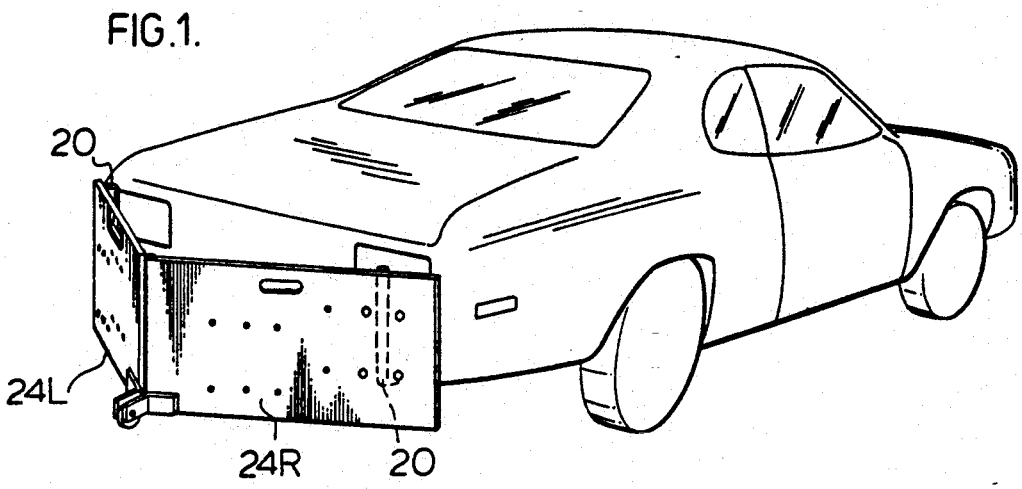
FIG. 1 is a perspective view of the invention mounted on an automobile.
Figure 2:
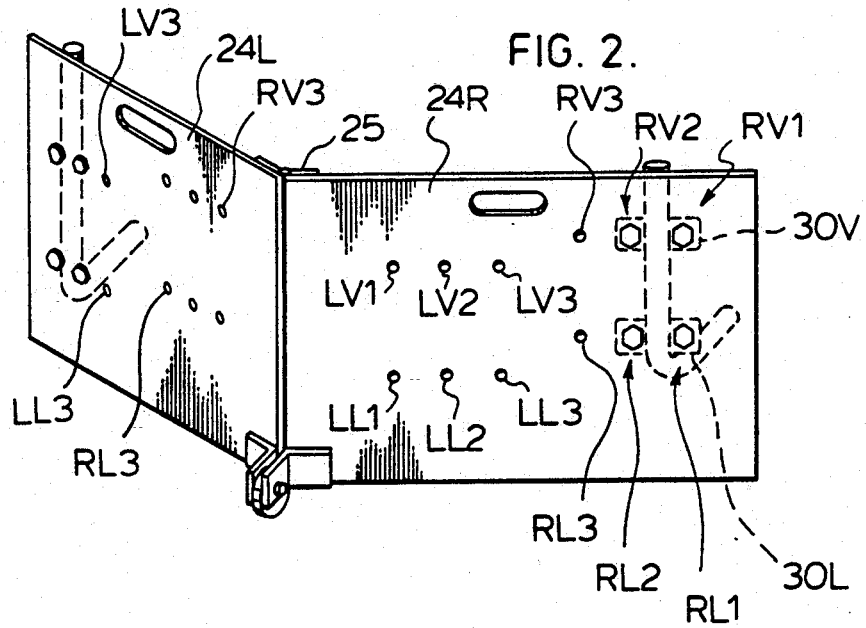
FIG. 2 is an enlarged view of the invention in mounted attitude.

In the drawings it is noted that the plow, in accord with the invention, may be mounted on the automobile's front or rear bumper. For many people it is preferable to mount the plow at the automobiles rear and the invention will be described in this sense although it will be realized that the front of the automobile may equally be the locale of the mount.

By 'outward' herein I mean forward relative to an automobile forward mount or rearward relative to an automobile rearward mount. 'Inward' has the opposite meaning.

The preferred chassis mounting brackets 10 are provided with a horizontal flange 12 and a vertical flange 14. The horizontal flange 12 preferably bolted but could be welded to the lower side of the auto chassis adjacent the outward end. The vertical flange is provided with a pair of vertical slots 16. A pair of arms each defines a vertical standard 20 and contiguously extending a horizontal extent 22. The horizontal extent 22 is provided with a pair of horizontal transverse bores spaced as are the slots 16. Thus bolts 24 are inserted in the extent bores and the corresponding slots 16, so that nuts may be tightened on the bolts, to clamp the horizontal extents 22 at the correct height to pass under the bumpers 26 and chassis. A choice of heights may equally be obtained with a series of vertically disposed holes in flange 14. The bolting maintains the shafts 20 approximately vertically extending and substantially parallel.

(It is within the scope of the invention to attach the vertical shafts 20 by any desired means, to the bumper. However this is difficult to do with many current automobiles).

A pair of hinged plates 24R and 24L are provided forming the operative member of the snow plow. Such plates may be made of metal but are preferably made of strong plastic and their strength must be calculated in accord with the snow loads to be encountered.

Figure 3:
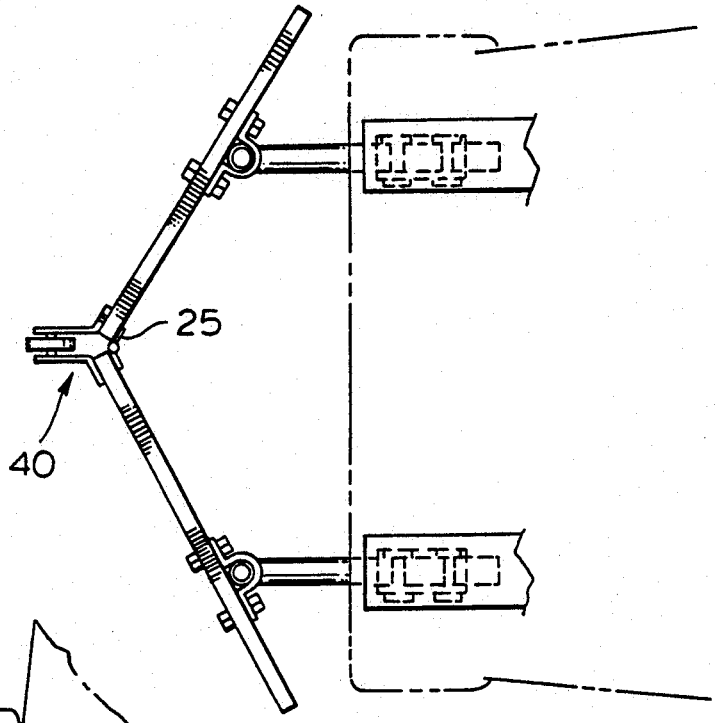
FIG. 3 is a plan view of the invention in mounted attitude.
Figure 4:
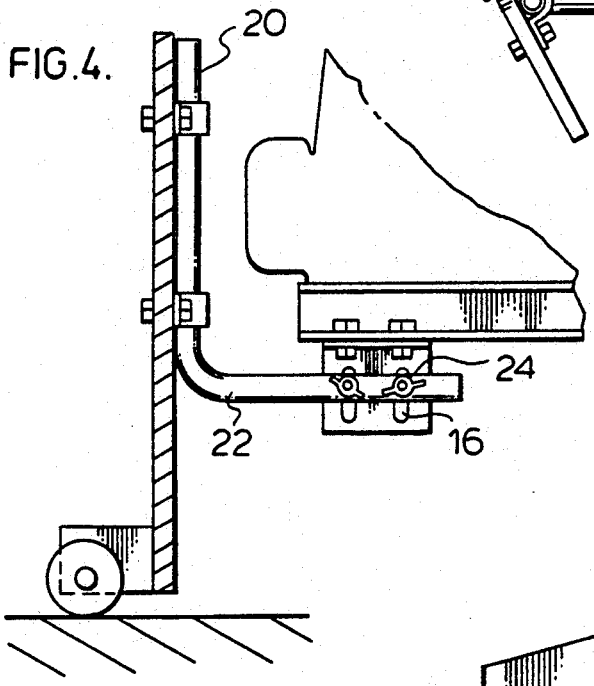
FIG. 4 shows the arm mounting means, with parts of the plates and of the automobile omitted for clarity.

The width of the plates 24R and 24L is preferably selected so that, in their correct angular arrangement, and as best shown in FIG. 3, the outer edges of the plate extend Just beyond (preferably about 3" beyond) the outer edges of the car.

The plates 24R and 24L are preferably designed that, before connection to hinges and brackets, they are identical and so that only a single mold is required. Thus each plate on level A is provided with three equally spaced holes RV1, RV2 and RV3 suitable for the attachment of an upper mounting bracket 30V when the plate is on the right of the plow, and at level B with similarly aligned lower holes RL1, RL2, RL3 suitable for the similar attachment of the lower mounting bracket 30L.

Thus as the right hand plate 24R an upper bracket 30V is mounted in holes RV1, RV2 (or RV2, RV3) and the lower bracket 30L is mounted is similarly aligned holes RL1, RL2 (or RL2, RL3), each vertically disposed from its counterpart in the other row to provide vertically aligned bores for the admission of a shaft 20.

The choice of using the outer or the inner pair of holes allows selection of the right pair to provide for the requisite angle between the plates. More holes may be provided to provide more hole pairs to increase the range of standard 20 spacing over which the correct standard spacing may be achieved.

Figure 5:
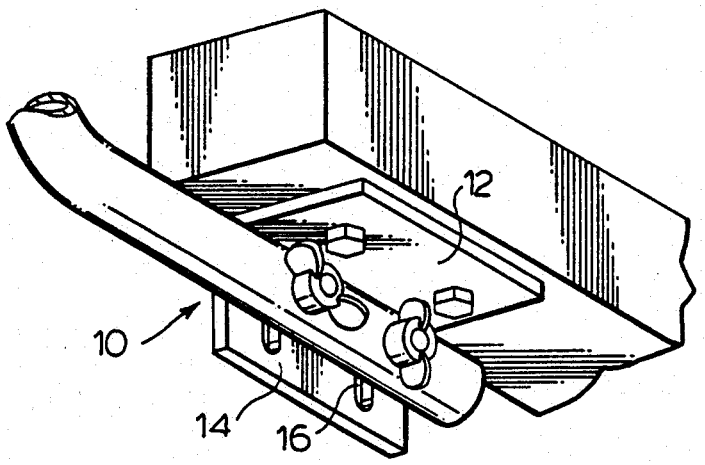
FIG. 5 shows a detail of the arm mounting means.

At the left hand side of each plate there are provided, at levels C and D respective series of holes LV1, LV2, LV3 and LL1, LL2, LL3 exactly similar to their right hand counterparts except that they are displaced from the right hand level A and B by the vertical dimension of the brackets, to allow the plow in its collapsed attitude to be folded to the position of FIG. 5 where the sheets may be brought closer together because of the vertical staggering of the brackets.

Thus in the assembly of the plates, a pair of plates 24 is joined by the upper and lower hinges 25 with the right and left bracket mounting holes disposed as shown. Then the correct bracket locations are selected having regard to the spacing of standards 20 on the particular automobiles to achieve the required 270° to 240° angular spacing, and the brackets attached (thus the left hand holes on the right plates), and vice versa are not used but are merely present as an incident of the desire to use only one die. The difference in height of the left and right hand brackets is of noconsequence since each rides on a vertical standard 20. The ground support means is then attached as hereinafter described.

The preferred ground support means provide a pair of relatively stiff plastic mouldings 40 each have a pair of wings 42.

Wings 42 are each apertured to allow bolting as shown at registering holes in a plate 24 between them and a wheel 48 is rotatably mounted thereon. Wheel 44 constitiutes the ground support means and its mounting and diameter is therefore selected to provide the desired clearance between the ground and the lower edges of plates 24.

Figure 6:
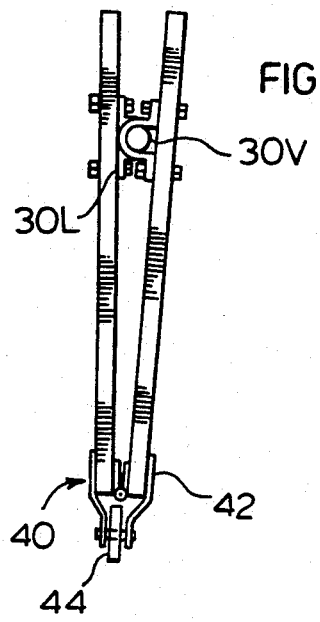
FIG. 6 shows the invention in collapsed position.

As demonstrated by FIG. 6 the mouldings 40 are only flexible enough to allow movement of the plow sheets from deployed to collapsed position.

It may be noted that the plastic mouldings 40 may, with wear, allow the roller to become misaligned or jam it against rotation. In the inventive plow this does not interfere with the plow operation. The reason is that even if the wheel jams it still acts as a skid to lift the lower edge of the plow plate over the low obstacles. It is also for this reason that skids or rollers, mounted in any conventional manner, are within the scope of the invention as ground support means.

The plates 24 are preferably provided with hand slots 38 adjacent the top edge and preferably centrally located relative to the horizontal dimension to allow lifting on and off of the standards 20.

The lower edges of the plates are preferably shaped to be parallel to a level ground surface.

In operation the standards 20 permanently mounted in place on the car chassis to project upwardly. The brackets 30 are then mounted on the plates so that, when riding on the shafts the outer surface of the plates will be at an angle of 270° to 240° and the ground support wheel 48 will support the plates so that the brackets are on the shafts but above their maximum lower excursion on the shafts.

With the brackets 30 so mounted, the plates 24, when not in use are folded into the near parallel positions (as shown in FIG. 6), with their inner faces adjacent and may be stored in many automobile trunks. The fact that the right and left hand brackets are staggered relative to each other allows the plates to be brought closer in their collapsed attitude as demonstrated in FIG. 6. When it is desired to use them, they are manipulated by the handgrips to be unfolded and pivoted until their brackets may be slid onto shafts 20. The plowing is performed with the plates maintained above the ground on support wheel 48. When the plowing is completed, the plates are again lifted off, folded into collapsed position and stored in the trunk of the automobile or elsewhere.

I claim:

1. A plow for automobiles comprising :

a pair of shafts, means for mounting said shafts on one end of an automobile, in spaced relationship, and extending roughly vertically, and substantially parallel to one another, a pair of plates hinged together each having a lower edge approximately perpendicular to a hinge axis, and defining an outward and an inward side, a mounting bracket on the inward side of each plate adapted to slidably receive one of the shafts, wherein said brackets are located and said shafts are spaced so that said plates will assume an angle where the outside faces are at 270°–240° of each other, wherein said brackets and shafts are designed to allow said plates to slide freely over a predetermined range, upwardly and downwardly thereon, wherein said plates are each dimensioned, to allow means on at least one of said plates to ride on the supporting surface for an automobile, within said range.

2. A plow as claimed in claim 1 wherein a support is mounted on said plates and supports the plates a predetermine distance above the support surface, said support being adapted to slide in the direction of auto travel relative to the support surface.

3. A plow as claimed in claim 1 wherein means are provided for defining a plurality of mounting locations for said brackets at different distances from said hinge, whereby said angular range may be achieved for varying shaft spacings.

4. A plow as claimed in claim 2 wherein means are provided for defining a plurality of mounting locations for said brackets at different distances from said hinge, whereby said angular range may be achieved for varying shaft spacings.

5. A plow as claimed in claim 1 including manual grasping means for removing said hinged plates from and applying said hinged plates to said shafts.

6. A plow as claimed in claim 1 wherein said hinged plates are adapted to be folded into near parallel relationship with said inward faces adjacent when said plates are removed from said shafts.

7. A plow for automobiles comprising :

a pair of plates hinged together, each having a lower edge approximately perpendicular to a hinge axis, and defining an outward side and an inward side, at least one mounting bracket on the inward side of each plate, said mounting bracket defining a bore approximately parallel to the hinge axis, said brackets being movable about said hinge from a position nearly parallel to a position where said outer faces are between 270° and 240° to each other.

8. A plow as claimed in claim 7 wherein a support is mounted on said plates and supports the plates a predetermined distance above a support surface, said support being adapted to slide in the direction of auto travel relative to the support surface.

9. A plow as claimed in claim 1 wherein means are provided for defining a plurality of mounting locations at different distances from said hinge.

10. A plow claimed in claim 8 wherein means are provided for defining a plurality of mounting locations at different distances from said hinge.

11. A plow as claimed in claim 7 including manual grasping means for lifting said hinged plates.

12. A plow as claimed in claim 7 wherein said hinged plates are adapted to be folded into near parallel relationship with said inward faces adjacent.

13. A plow as claimed in claim 1 wherein said pair of pates before attachment of other means are identical so that either can be used as a right or a left hand plate.

14. A plow as claimed in claim 7 wherein said pair of plates, before attachment of other means are identical so that either can be used as a right or a left hand plate.

* * * * *